US011786927B2

(12) United States Patent
Reuter et al.

(10) Patent No.: US 11,786,927 B2
(45) Date of Patent: Oct. 17, 2023

(54) ROTARY METERING HEAD

(71) Applicant: MARCO SYSTEMANALYSE UND ENTWICKLUNG GMBH, Dachau (DE)

(72) Inventors: Martin Reuter, Dachau (DE); Jakob Reuter, Dachau (DE)

(73) Assignee: Marco Systemanalyse und Entwicklung GmbH, Dachau (DE)

( * ) Notice: Subject to any disclaimer, the term of this patent is extended or adjusted under 35 U.S.C. 154(b) by 498 days.

(21) Appl. No.: 16/838,514

(22) Filed: Apr. 2, 2020

(65) Prior Publication Data

US 2020/0316633 A1 Oct. 8, 2020

(30) Foreign Application Priority Data

Apr. 5, 2019 (DE) ..... 102019109034.2

(51) Int. Cl.
*B05B 15/652* (2018.01)
*B05B 1/30* (2006.01)
*B05B 1/10* (2006.01)

(52) U.S. Cl.
CPC ..... *B05B 15/652* (2018.02); *B05B 1/10* (2013.01); *B05B 1/3046* (2013.01)

(58) Field of Classification Search
CPC ... B05B 15/68; B05B 15/652; B05B 13/0431; B05B 13/0484; B05B 13/0421; B25J 11/0075
See application file for complete search history.

(56) References Cited

U.S. PATENT DOCUMENTS 5,439,029 A * 8/1995 Becker ..... F16L 39/04 285/101
6,132,809 A * 10/2000 Hynes ..... B05B 13/0431 118/313
8,479,766 B2 * 7/2013 Hugel ..... B41F 13/085 137/580
2004/0140371 A1 * 7/2004 Engel ..... B05C 5/02 239/145
2011/0120372 A1 5/2011 Chang et al.
2016/0067732 A1 * 3/2016 Nakamura ..... B25J 18/007 427/427.2
2017/0157772 A1 6/2017 Neumeier

FOREIGN PATENT DOCUMENTS

CN 203197076 U * 9/2013
CN 106513256 A 3/2017
DE 10139645 A1 3/2003
DE 10337803 A1 3/2005
DE 102014209172 A1 11/2015
DE 102014209177 A1 11/2015

(Continued)

OTHER PUBLICATIONS

Search report regarding related DE App. No 10 2019 109 034.2; dated Feb. 2, 2020.

(Continued)

*Primary Examiner* — Jason J Boeckmann
(74) *Attorney, Agent, or Firm* — Dickinson Wright PLLC

(57) ABSTRACT

A rotary metering head comprises a platform which is rotatable about an axis of rotation and on which a jet valve is arranged that serves for the jetting of fluid materials.

11 Claims, 2 Drawing Sheets

(56) References Cited

FOREIGN PATENT DOCUMENTS

Figure 1:
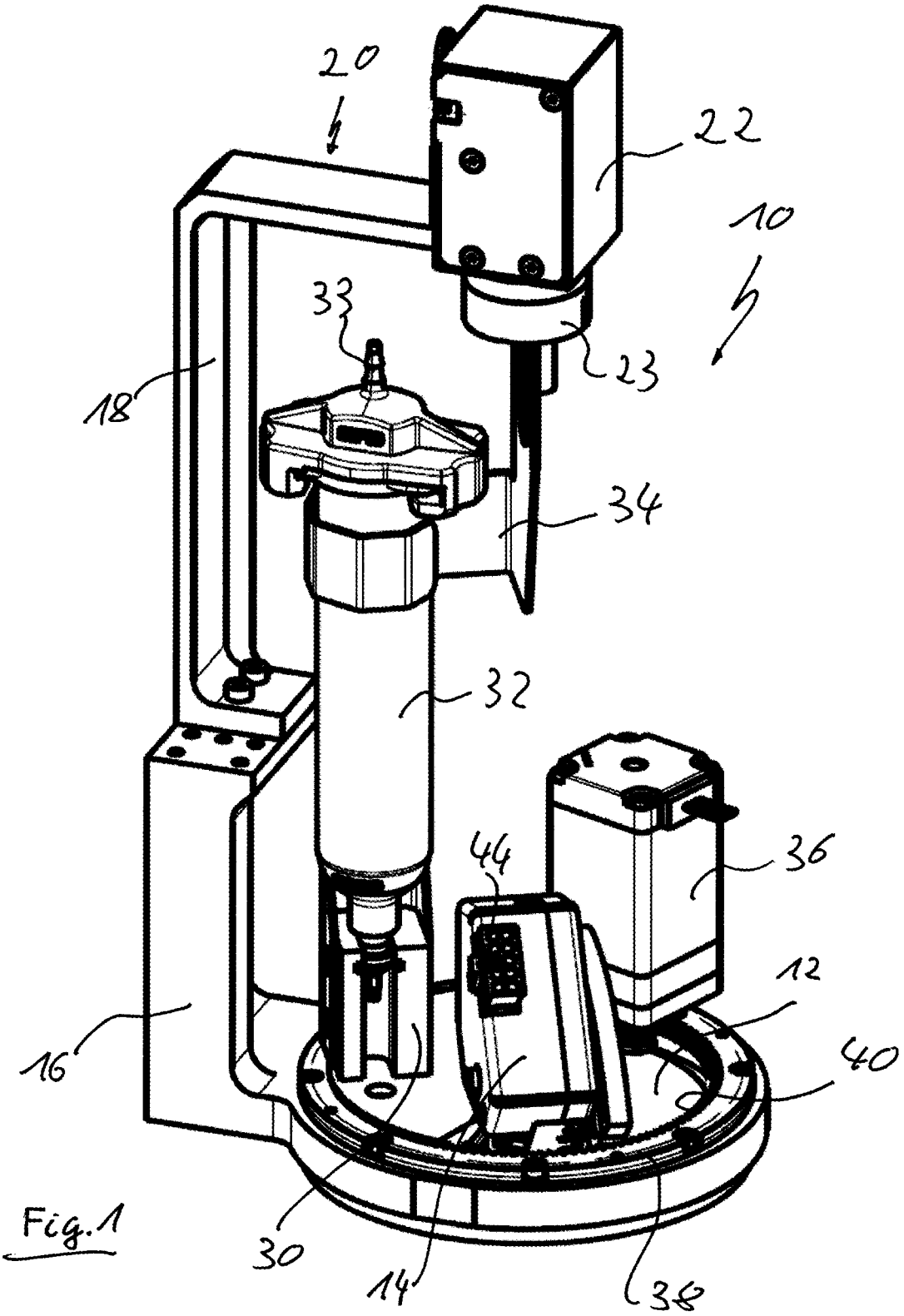

| | | | |
|---|---|---|---|
| EP | 2954956 | A1 | 12/2015 |
| JP | 3086066 | U | 5/2002 |
| JP | 2012088396 | A | 5/2012 |
| JP | 2014153297 | A | 8/2014 |
| JP | 2015188783 | A | 11/2015 |
| KR | 10-2014-0011114 | A | 1/2014 |
| KR | 10-2018-0133974 | A | 12/2018 |

OTHER PUBLICATIONS

Official Communication from the Japanese Patent Office dated Mar. 30, 2021 for Japanese Application No. 2020-067325, 5 pages.

* cited by examiner

ROTARY METERING HEAD

Adhesive processes are necessary for a large number of production steps in the manufacture of electronic components and devices such as smartphones and tablets. Jet valves are frequently used for this purpose since they allow a contactless application of the adhesive—or also other media—, on the one hand, and above all also enable very high metering frequencies. It may also be necessary for specific applications to apply the medium by means of contact metering. In this case, the metering valve (jet valve) typically has a metering needle and is moved along the path to be metered at a very small spacing between the metering needle and the workpiece.

The application of the medium onto the workpiece takes place perpendicular to the respective workpiece for many applications. The valve and the workpiece are moved toward one another with the aid of multiaxial robots in this process. These robots typically have three axes, namely two axes for the movement in the plane of the workpiece (x axis and y axis) and one axis for movements perpendicular to the workpiece (z axis). However, it is advantageous for many metering applications to not apply the medium in a perpendicular manner, but rather at a defined angle. This is e.g. the case when metering has to take place in edges and the medium has to cover both a specific surface of the x-y plane and also perpendicular thereto in so doing or also if metering has to take place onto perpendicular surfaces of the workpiece. An oblique application can also be advantageous for underfill processes.

Today, a commercial metering valve is used for an oblique jetting and/or metering and is moved by additional axles at the robot. However, the pivot point is thereby far away from the metering point. This arrangement is unsuitable to then nevertheless precisely implement the control.

In known metering systems, the position of the metering tip changes depending on the angle and the rotation since the tip of the metering valve is disposed outside the axis of rotation. In this case, the tip moves around the axis in a circle or a sphere. Since the spacing between the valve and the workpiece has to be small for a stable and precise metering (no satellite formation, exact position of the medium applied), the design of typical jet valves does not allow an oblique installation in a robot. Edges and inwardly disposed surfaces can then frequently only be reached by long needles that in turn make a jet operation of the valve more difficult or even prevent it.

It is the object of the invention to provide a rotary metering head for jetting fluid materials that can be manufactured inexpensively and that in particular enables a simple control of a robot that moves the metering head.

This object is satisfied by the features of claim 1 and in particular in that the rotary metering head has a rotary platform which is rotatable about an axis of rotation, which is freely rotatable by 360° about the axis of rotation, and on which a jet valve that has a metering axis is arranged. In accordance with the invention, the jet valve is arranged on the rotary platform such that the point of intersection between the metering axis and the axis of rotation also remains unchanged on a rotation of the rotary platform.

In the rotary metering head in accordance with the invention, the center of the rotation of the rotary platform is equal to the metering point, whereby no change of the metering point is performed on a rotation of the rotary platform either. No complicated control or readjustment of a robot that moves the rotary metering head hereby has to take place.

The same applies to the case that a changed nozzle geometry is present by which the metering spacing is changed.

Advantageous embodiments of the invention are described in the description, in the drawing and in the dependent claims.

In accordance with a first advantageous embodiment, a rotary leadthrough freely rotatable by 360° can be provided for an electrical and fluidic supply of the rotary metering head. In this manner, the jet valve can be rotated by 360° or more in any desired direction and as often as desired, whereby the rotary metering head can be used in a great variety of manners. At the same time, the calculation and control of the movement is also greatly simplified in contrast to known systems.

In contrast to known systems that enable a change to the metering angle, with the rotary metering head in accordance with the invention, the metering point does not have to be recalculated by the robot control or system control and compensated by a correspondingly changed robot movement on a change to the metering spacing or metering angle.

In accordance with a further advantageous embodiment, an entrainer can be provided between the rotary platform and a rotatable part of the rotary leadthrough. In this manner, the rotary leadthrough is not rotated solely by cables or lines so that a strain relief is provided.

In accordance with a further advantageous embodiment, a cartridge holder can be provided on the rotary platform so that a cartridge having a fluid, for example an adhesive, can be rotatably attached in the proximity of the valve and together with the valve.

In accordance with a further advantageous embodiment, the jet valve can be adjustably fastened to the rotary platform, and indeed such that said jet valve is adjustable in the longitudinal direction in parallel with the metering axis and such that the angle between the metering axis and the axis of rotation can be set. Different metering angles and different metering spaces can hereby be set without the control by the robot having to be changed. An angular adjustment can, for example, take place between 0° and 45°, wherein, however, angles of up to 90° and more can also be set, depending on the manner of construction, that allow a metering to be carried out from an oblique angle in complicated geometries. Due to the free rotation, the possibility of metering around a workpiece at the preset angle is nevertheless provided in this respect. Since the tip of the valve always faces toward the axis of rotation and the spacing of the valve from the axis of rotation can be adjusted, metering always takes place onto one and the same point. The center of the rotation of the rotary platform and of the angular change of the jet valve is always the metering point that thereby also always remains unchanged on an angular adjustment.

In accordance with an advantageous embodiment, a respective scale can be provided for the adjustment of the longitudinal adjustment and/or of the angular adjustment of the jet valve, which simplifies a manual setting or adjustment of the metering spacing and of the metering angle.

In accordance with a further advantageous embodiment, a rotary drive that, for example, has an electric motor can be provided on the rotary platform. The rotary platform can hereby be driven via a sprocket having internal teeth, whereby the toothed arrangement of the drive is accommodated in a protected manner. In addition, the construction size of the total system can hereby be kept extremely small. The larger the total system is, the more the work zone of the robot with the installed metering system will be restricted. Therefore, a compact design is an important aspect. The size of the rotary platform is substantially determined by the space necessary for the rotatable metering valves. The motor can, however, still be integrated within the radius of the platform necessary for the valve.

Figure 2:
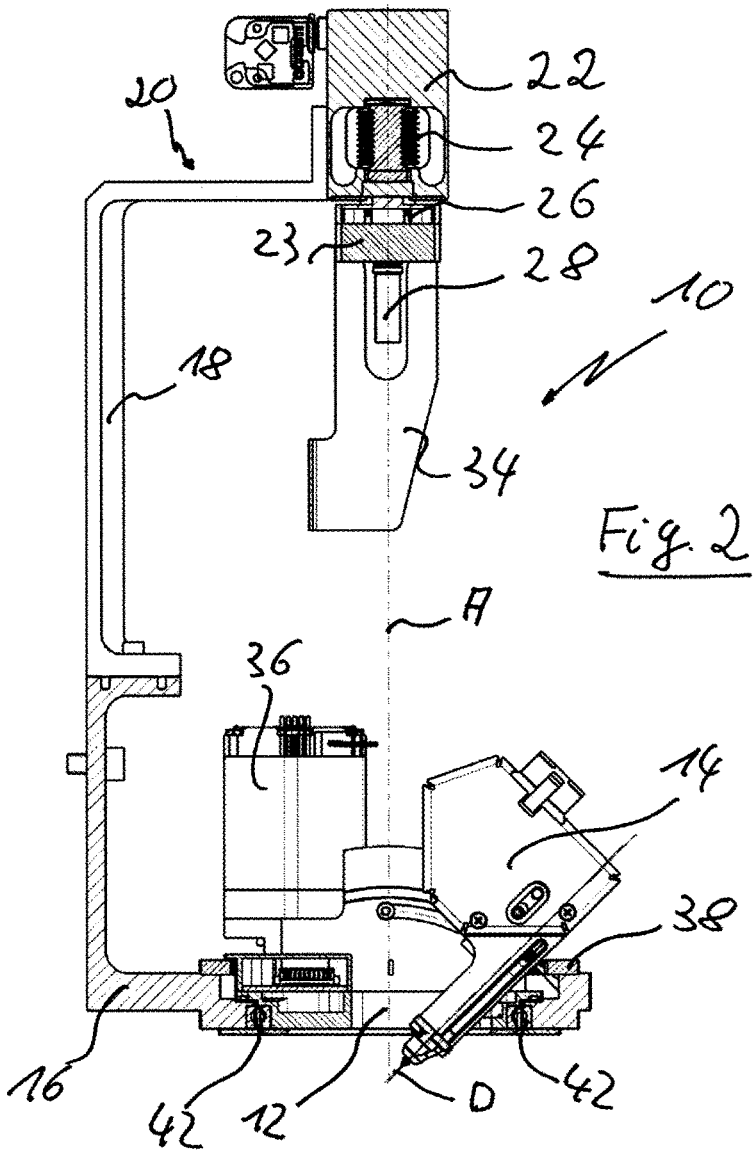
Figure 3:
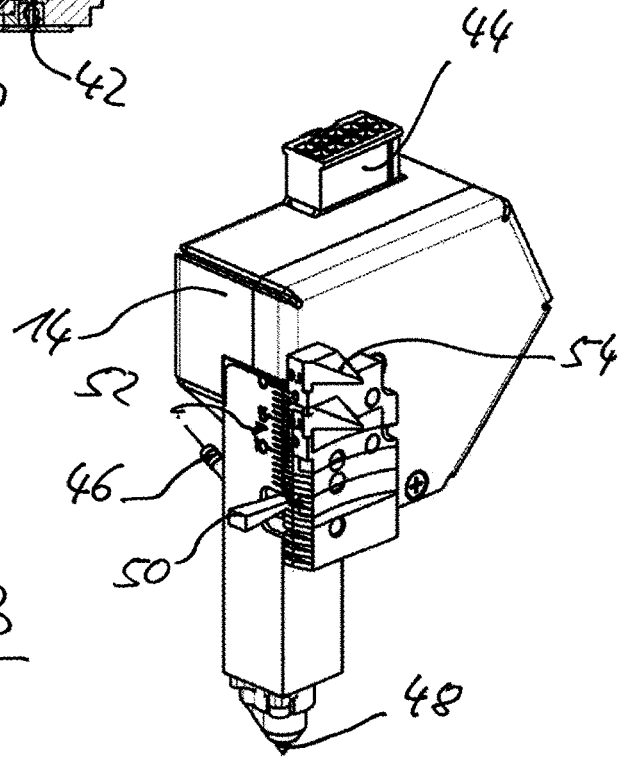

The present invention will be described in the following purely by way of example with reference to an advantageous embodiment and to the enclosed drawings; there are shown:

FIG. 1 a perspective view of a rotary metering head;

FIG. 2 a partly sectioned view of the rotary metering head of FIG. 1 without an inserted cartridge; and FIG. 3 a perspective view of the jet valve of the rotary metering head of FIG. 1 and FIG. 2.

The rotary metering head 10 shown in FIG. 1 and FIG. 2 serves for the jetting of fluid materials, for example adhesives, and comprises a rotary platform 12 which is rotatable about an axis of rotation A (FIG. 2), which is freely rotatable by 360° about the axis of rotation A, and on which a jet valve 14 that has a metering axis D is arranged. Very small quantities of fluid to be metered are ejected (jetted) onto a workpiece (not shown) along the metering axis D.

The metering platform 12 is arranged on a holder 16 approximately of L shape in cross-section, wherein the assembly platform 12 is located in the limb of the holder 16 that is horizontal in the Figures. The vertical limb of the holder 16 can be fastened to a metering robot. A further, likewise substantially L-shaped support 18 is fastened to the upper side of the vertical limb of the holder 16 and has a collar arm 20 which projects over the rotary platform 12 and to whose free end a rotary leadthrough 22 freely rotatable by 360° is fastened such that its axis of rotation extends coaxially to the axis of rotation A (FIG. 2). The rotary leadthrough 22 has a plurality of electrical sliding contacts 24 and a rotary leadthrough 26 for a fluidic supply of the rotary metering head that opens into a stub 28. An electrical supply of the rotary metering head can take place via the sliding contacts 24, namely a control of an electric drive and a control of the jet valve 14. The fluid to be jetted can be acted on by pressure via the fluidic leadthrough.

As FIG. 1 illustrates, a cartridge holder 30 into which a cartridge 32 filled with fluid can be inserted is provided on the rotary platform 12. The fluid present in the cartridge can be acted on by pressure, on the one hand, and can be conveyed to the jet valve 14, on the other hand, by hose connections, not shown in more detail, between the cartridge 32 and the jet valve 14 as well as between the stub 28 of the rotary leadthrough 22 and a stub 33 of the cartridge. In order in this respect to relieve the hose connection present between the cartridge 33 and the rotary leadthrough 22 and the electrical lines present between the rotary platform 12 and the rotary leadthrough 22 on a rotation, an entrainer 34 is provided between the cartridge holder 30 and a rotatable part 23 of the rotary leadthrough 22 such that the rotatable part 23 of the rotary leadthrough 22 rotates about the axis of rotation A together with the rotary platform 12. An electric motor 36 is provided on the rotary platform 12 for a drive of the rotary platform 12 about the axis of rotation A, said electric motor 36 engaging via a toothed wheel into a sprocket 38 that has internal teeth 40 and that is fastened on the horizontal limb of the holder 16. The rotary platform 12 supported in a ball bearing 42 thus rotates about the axis A on the drive of the electric motor 36.

FIG. 3 shows an enlarged perspective representation of the jet valve 14 that has a plug 44 for an electrical supply at its upper side and has a lateral stub 46 for the supply of the medium to be jetted. An outlet nozzle 48 is adjustably arranged at the jet valve 14 and can be adjusted along the metering axis D with the aid of an adjustment lever 50, wherein a scale 52 is provided for a simplified setting. The metering spacing, i.e. the spacing between the nozzle tip 48 and the point of intersection between the metering axis D and the axis of rotation A (metering point), can be adjusted in this manner.

The jet valve 14 is furthermore fastened to the rotary platform 12 such that the angle between the axis of rotation A and the metering axis D can be set manually. Indicators 54 are in this respect provided at the jet valve 14 for a simplified setting such that the set angle can be read off at a scale that is not recognizable in the Figures.

Due to the above-described rotary metering head, a control of the metering robot of very little complexity can take place since the robot always has to travel the same distance even with a changed metering spacing, a new nozzle geometry, a changed rotation or a changed metering angle without the robot control having to perform a compensation.

The invention claimed is:

1. A rotary metering head for jetting fluid materials, the rotary metering head comprising, a rotary platform which is rotatable about an axis of rotation, which is freely rotatable by 360° about the axis of rotation, and on which a jet valve that has a metering axis is arranged such that a point of intersection between the metering axis and the axis of rotation remains unchanged on a rotation of the rotary platform, an electric motor mounted on the rotary platform, said electric motor rotating the rotary platform about the axis of rotation by 360°, a cartridge holder mounted on the rotary platform, a rotary leadthrough freely rotatable by 360° for an electrical supply and a separate fluidic supply of the rotary metering head, and an entrainer provided between the rotary platform and a rotatable part of the rotary leadthrough to transmit rotation of the rotary platform to the rotatable part, thereby facilitating co-rotation of the rotary platform and the rotatable part.

2. The rotary metering head in accordance with claim 1, wherein the jet valve is adjustably fastened to the rotary platform such that said jet valve is adjustable in the longitudinal direction in parallel with the metering axis and such that the angle between the metering axis and the axis of rotation can be set.

3. The rotary metering head in accordance with claim 2, wherein the angle between the metering axis and the axis of rotation can be set between at least 0° and 45°.

4. The rotary metering head in accordance with claim 2, wherein the point of intersection between the metering axis and the axis of rotation remains unchanged on an adjustment in the longitudinal direction and/or on an angular adjustment.

5. The rotary metering head in accordance with claim 2, wherein a scale is provided for the adjustment in the longitudinal direction and/or for an angular adjustment.

6. The rotary metering head in accordance with claim 1, wherein the rotary platform is driven via a sprocket.

7. The rotary metering head in accordance with claim 6, wherein the sprocket has internal teeth.

8. The rotary metering head in accordance with claim 1, wherein the electrical supply includes a plurality of sliding contacts.

9. The rotary metering head in accordance with claim 1, wherein the rotary leadthrough includes a first rotary leadthrough providing the electrical supply and a second rotary leadthrough providing the fluidic supply.

10. The rotary metering head in accordance with claim 1, wherein the electrical supply channels electrical power to the jet valve.

11. The rotary metering head in accordance with claim 1, wherein the electrical supply channels electrical power the electric motor.

* * * * *